US005389009A

United States Patent [19]

Van Schenck, III

[11] Patent Number: 5,389,009

[45] Date of Patent: Feb. 14, 1995

[54] BATTERY SUBSTITUTE DEVICE

[76] Inventor: George A. Van Schenck, III, 20247 Telegraph Square La., Katy, Tex. 77449

[21] Appl. No.: 96,969

[22] Filed: Jul. 27, 1993

[51] Int. Cl.[6] ..... H04R 25/02

[52] U.S. Cl. ..... 439/500; 381/69.2

[58] Field of Search ..... 439/500; 381/60, 68, 381/69.1, 69.2; 73/585

[56] References Cited

U.S. PATENT DOCUMENTS 4,548,082 10/1985 Maynard ..... 73/585
4,961,230 10/1990 Rising ..... 381/69.2
5,188,540 2/1993 Haertl et al. ..... 439/500

*Primary Examiner*—Neil Abrams
*Attorney, Agent, or Firm*—Marvin J. Marnock

[57] ABSTRACT

A battery substitute device (9) for use with apparatus for testing a hearing aid instrument (12) of the ear-worn type which has a battery compartment with a door for access thereto and hearing aid contact terminals located in the battery compartment at a spacing from one another which is suited for engagement with the battery electrodes. The battery substitute device comprises a flexible electrical cable (10) which includes a pair of electrical conductors (18) and a first connector (15–17) at one end for electrically coupling to a source of d.c. power (13). A second connector provided at the opposite end of the cable (10) comprises a pair of resilient plate contact members (21, 22) in laterally spaced parallel array, each of which is electrically connected to a different one of the cable conductors (18) with a first end portion (23) of each plate contact member being encapsulated in a molded pod (31) and the spacing between said plate contact members being slightly less than the thickness of the battery and the thickness of the battery compartment door whereby when the hearing aid battery is removed from the battery compartment, the plate contact members of the second connector may be placed in straddling position around the battery compartment door to cause their outward divergence and then flexed towards one another and inserted into the battery compartment by closing the battery compartment door to thereby make electrical contact with the contact terminals of the hearing aid.

6 Claims, 2 Drawing Sheets

BATTERY SUBSTITUTE DEVICE

FIELD OF THE INVENTION

The invention relates to apparatus used in testing of hearing aids and, more particularly, to an apparatus for coupling to a hearing aid as a substitute for a button battery when conducting performance tests of the hearing aid.

BACKGROUND ART

The standard testing of hearing aids involves the evaluation of the hearing aid performance over a specified range of sound frequencies and sound levels. The current drain under such conditions of operation is also of significant interest in testing but to test for such requires the use of a battery substitute for supplying power to the hearing aid for measuring the instrument's current drain since the hearing aid current drain cannot be measured with a button battery installed therein. For hearing aids which incorporate a small button battery, such as is used in hearing aids which are ear worn, the connecting cable for delivering electrical power from the substitute power source must be flexible, adapted for good electrical coupling by making firm conductor contact with the electrical terminals of the hearing aid and be able to withstand the strains associated with repeated usage and flexing.

A battery substitute cable now in wide use utilizes flexible strips of sheet-like conductor material in a laminar arrangement with an insulator therebetween. The cable is provided at one end with an adapter of circular cylinder configuration which is sized to fit into the battery compartment of the hearing aid and has two electrical contact elements which engage the terminals of the hearing aid when it is placed in the battery compartment, and the battery compartment is closed by a hinged door, usually arcuate in shape, but having a transverse width dimension which corresponds to the axial thickness of the button battery. The electrical connection of the adapter to the cable conductors is a pressure clamp connection wherein each of the cable conductors is subjected to two ninety degree bends. As a result, this type of a battery substitute cable is characteristically fragile and tends to break or "short out" after a relatively short lifetime of usage.

SUMMARY OF THE INVENTION

The invention is a battery substitute device for use with apparatus for testing a hearing aid instrument of the ear worn type which has a battery compartment with a door opening for access thereto, and the width of the door corresponds to the thickness of the hearing aid battery. The hearing aid contact terminals are located in the battery compartment at a spacing suited for engagement with the battery electrodes. The battery substitute device of the invention comprises a flexible electrical cable which includes a pair of electrical conductors and a first connector at one end for electrically coupling the cable to a source of d.c. power. A second connector is provided at the opposite end of the cable. The second connector comprises a pair of resilient plate contact members in laterally spaced parallel array, each of which is electrically connected to a different one of the cable conductors with a first end portion of each plate contact member being encapsulated in a rigid molded pod and the spacing between said plate contact members being slightly less than the widths of the battery compartment door and the hearing aid battery whereby when the hearing aid battery is removed from the hearing aid battery compartment, the plate contact members of the second cable connector may be placed in straddling relation around the battery compartment door and flexed towards one another and inserted into the battery compartment by closing the door to cause the plate contact members to make electrical contact with the contact terminals of the hearing aid.

BRIEF DESCRIPTION OF THE DRAWINGS

FIG. 6 is an enlarged fragmentary section view through the battery compartment of a hearing aid from which the battery has been removed and the battery substitute of the invention is received therein.

DETAILED DESCRIPTION OF THE INVENTION

Figure 1:
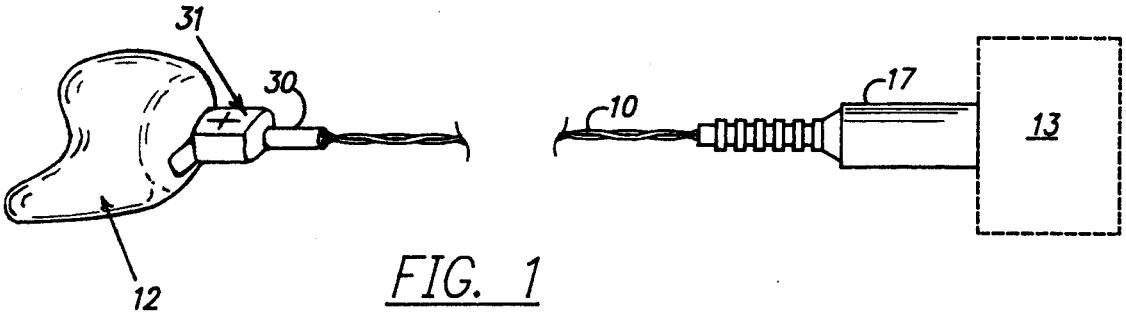
FIG. 1 is a view in perspective showing the battery substitute cable of the invention installed in a hearing aid.
Figure 5:
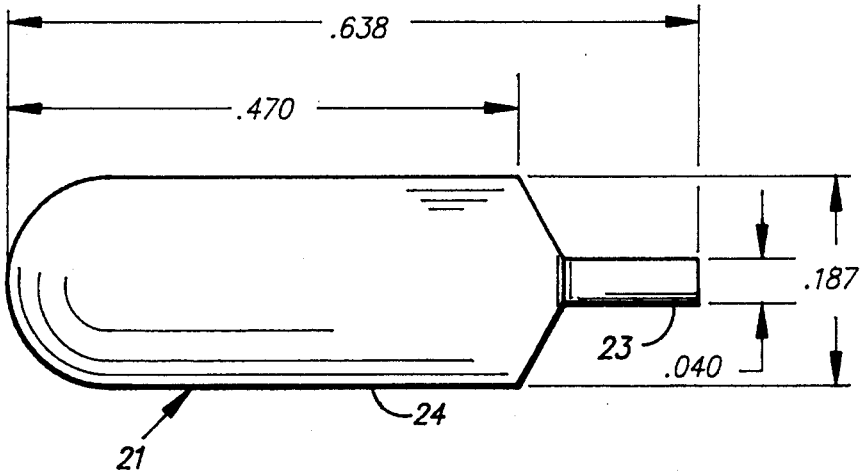
FIG. 5 is an enlarged plan view of one of the plate contacts that are encapsulated in the adapter pod shown in FIG. 4*a;*

Referring more particularly to the drawings, there is shown in FIG. 1 a battery substitute device 9 comprising a cable 10 which is coupled at one end to a hearing aid 12. At its other end, the cable 10 is provided with a standard connector plug comprising a pair of coaxially disposed contacts 15, 16 which are partially encapsulated in a conventional rubber housing 17 and suitable for connection in a terminal socket of a power supply 13. The cable 10 comprises a pair of electrical conductors 18 in a helically twisted arrangement which, at the end of the cable adapted for coupling to the hearing aid 12, are connected by soldering or welding to different members of a pair of plate contacts 21, 22. The plate contact terminal members 21, 22 are formed of hardened stainless steel, each having an elongate configuration as shown in FIG. 5, with an enlarged section 24 and an adjoining narrow end portion 23 to which a cable conductor 18 is soldered or welded. At its distal end, each plate contact is also formed with a curved edge 25, preferably of a semicircular configuration.

Figure 2:
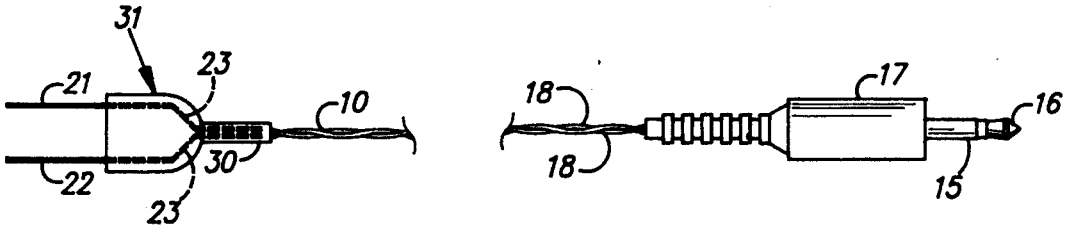
FIG. 2 is a plan view of the battery substitute cable of the invention.
Figure 3:
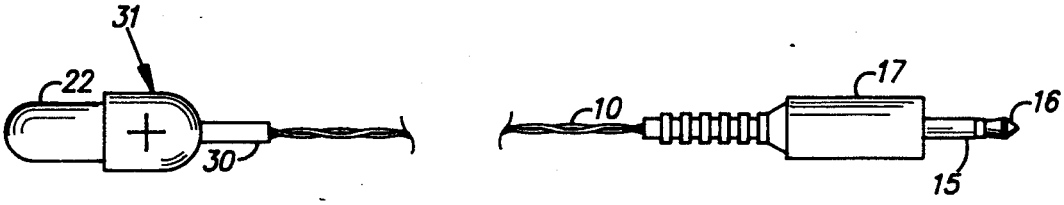
FIG. 3 is a side view of the cable of FIG. 2.
Figure 4A:
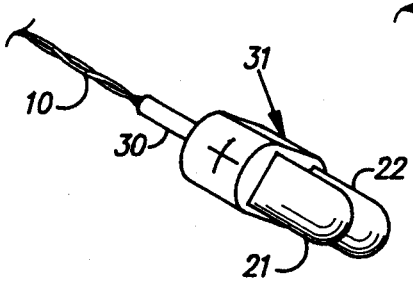
FIG. 4*a* is an enlarged fragmentary view in perspective of the cable of FIG. 2 showing the rigid molded adapter pod which holds the cable end plate contacts for contacting terminals of the hearing aid.
Figure 4B:
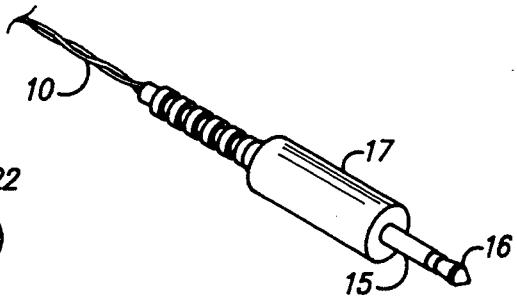
FIG. 4*b* is an enlarged fragmentary view in perspective of the other end of the cable of FIG. 1.

The end portion of each of the cable conductors 18 adjacent to its connection with a plate contact member 21, 22 is provided with a sleeve of snugly fitting tubing 30 such as silicone tubing or other type material which can provide strain relief for the cable conductors. The plate contact members are held in rigid laterally spaced parallel relationship to one another by encapsulation of their narrow end portions 23 and portions of their sections 24 by a hardened plastic material such as acrylic polymer which forms an adaptor pod 31 at the end of the cable. As shown in FIG. 2, the narrow portions 23 of the plate contact members are bent inwardly towards one another for their connection with the ends of the cable conductors. The adaptor pod 31 is formed by molding to solidify about the end portions 23 and a next adjacent portion of the enlarged section 24 of each plate contact member. The silicone tubing 30 extends a slight distance into the pod 31 in which it is partially encapsulated and extends a limited distance outwardly of the plastic pod 31 by an amount which is sufficient to provide strain relief for the cable from flexing forces which may be imposed on the cable 10, particularly at the exit location of the cable conductors from the pod 31.

Figure 6:
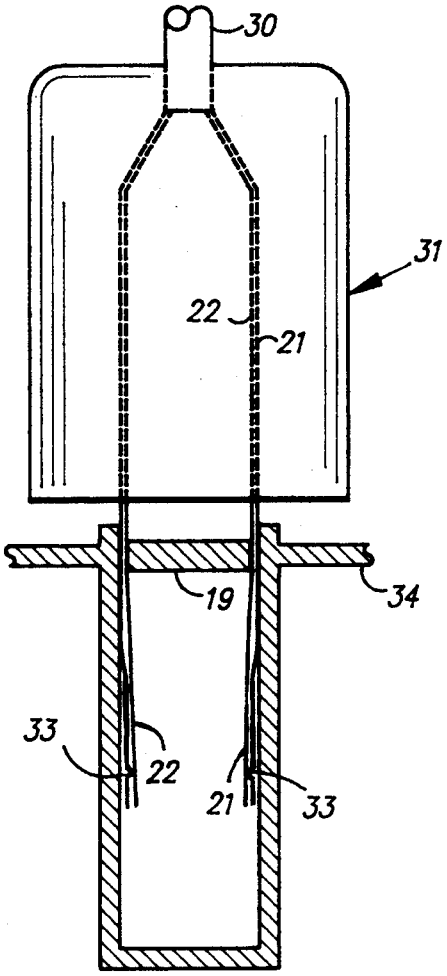
FIG. 6 is a perspective exploded view showing a hearing aid with an open battery compartment and with an adapter pod as shown in FIG. 4*a* in proximity thereto in preparation for placing the cable end plate contacts in straddle relation to the compartment door.

The plate contact members are mounted in the pod 31 in a very precise spacing from one another which is slightly smaller than the thickness of the battery designed for the hearing aid and the width of the hinged battery compartment door which opens and closes the battery compartment. The stainless steel contact members are also designed with a limited degree of flexibility and resiliency so that they may be readily placed in straddle relation about the compartment door and also squeezed towards one another at their distal ends by a slight amount sufficient to allow their easy insertion into the hearing aid battery compartment 11 around the battery compartment door 19 of a hearing aid 12 as shown in FIG. 6. The door 19 is conventionally of arcuate configuration, is hinged at one end, and provided with a transverse width dimension which equals in size or closely approximates the thickness, or axial dimension, of the cylindrical button battery for which the battery compartment is designed.

As previously stated, the testing of a hearing aid customarily includes a determination of the current drain of the hearing aid instrument when performing over a range of sound frequencies and sound levels. Since this must be done with the hearing aid battery removed from the hearing aid, a battery substitute device must be used.

It will therefore be seen that the battery substitute device 9 of the present invention comprises a flexible electrical cable 10 which can be coupled to a d.c. voltage source 13 and is provided at its other end with a pair of plate contact terminals mounted in a rigid adapter pod 31 at a spacing slightly smaller than the thickness of the hearing aid battery and the width of the battery compartment door land is also adapted to provide good electrical coupling with the electrical terminals of the hearing aid. The typical voltages which are available from the substitute power source are 1.35 volts, 1.4 volts and 1.5 volts. When the plate contact terminals are inserted around the battery compartment door, the rigid adapter pod must be oriented for polarity alignment such that the positive terminal of the cable engages the positive terminal contact of the hearing aid. Because of the resiliency of the plate contact terminals of the cable, they can be readily placed in a straddle position around the battery compartment door with respect to its width dimension. Because the spacing of the plate contacts as mounted in the pod 31 is narrower than the battery thickness and the width of the battery compartment door is battery thickness size, the straddle positioning of the plate contact members with respect to the door will cause them to spread and diverge outwardly in the direction of their distal ends. However, they may then be squeezed to narrow their spread at their distal ends to allow their insertion into the hearing aid battery compartment by closing the battery compartment door.

Because of their resiliency, the plate contact members when installed in the battery compartment as shown in FIG. 6 are biased to return to their spread out diverging relationship and thereby make firm contact with the hearing aid terminals 33 located in the battery compartment. The terminals 33 are resiliently mounted from the face plate 34 of the hearing aid and are spaced such they are wedged apart by the battery electrodes where the battery is in the hearing aid and are similarly wedged apart by the plate contact terminals 21, 22 of the battery substitute device when installed in place of the battery. It is also to be noted that the closing of the battery compartment door tends to clamp the plate contact members in the battery compartment in a tight friction fit and is also important when conducting testing of the hearing aid since an open door may disadvantageously influence the test results because the hearing aid is not in the configuration it has when worn in the ear. The length dimension of the plate contact terminals which project from the plastic pod 31 is determined by the depth of the hearing aid battery compartment, which in most hearing aids corresponds to the diameter of the button battery.

A representative plate contact terminal with typical dimensions suitable for the battery substitute device of the invention are illustrated in FIG. 5. As shown in FIG. 5, the plate terminal 21 is provided with an overall length of 0.638 inches, a thickness of 0.005 inches and a width of 0.187 inches. However, since the hearing aids in use today are designed with various button batteries of different sizes, it is to be understood that the battery substitute device of the present invention can also be designed with different spacings between the plate contact terminals and different physical dimensions for the plate contact terminals to accommodate its use with a specific hearing aid.

Once the plate contact terminals 21, 22 are properly installed in the hearing aid battery compartment, the battery substitute device of the invention can then power the hearing aid to be tested when plugged into the testing equipment. Upon completion of testing, the flexible cable of the battery substitute device can be readily uncoupled by just pulling on the pod 31 to remove the plate contact terminals from the hearing aid battery compartment.

It is to be understood therefore that the foregoing description of a preferred embodiment of the invention has been presented for purposes of illustration and explanation and is not intended to limit the invention to the precise form disclosed. A rigid material other than acrylic polymer might be used for the pod 31, for example, although acrylic polymer has many desirable features, such as suitability for injection molding, ease of hand pouring, and relatively rapid hardening in the mold. In addition, different dimensions for the various cable and connector components might by employed as previously described. It is to be appreciated therefore that various material and structural changes may be made by those skilled in the art without departing from the spirit of the invention.

I claim:

1. In an apparatus for testing a hearing aid instrument where the hearing aid instrument includes a housing having a battery compartment therein with an access opening to said compartment and first and second contact terminals provided in said compartment in laterally spaced relationship for engaging the electrodes of the hearing aid battery when the battery is received in said compartment and said battery compartment is provided with a door having a width corresponding to the thickness of the battery and adapted to close said opening, said improvement comprising:

a flexible electrical cable including a pair of electrical conductors and having a first connector at one end for electrically coupling the cable to a source of d.c. power;

a second connector at the opposite end of said cable, said second connector comprising a pair of resilient plate contact members in laterally spaced parallel array, each plate contact member being electrically connected to a different one of the cable conductors with a first end portion of each plate contact member being encapsulated in a rigid molded insulating pod and the spacing between said plate contact members being slightly less than the thickness of the button battery, each of said plate contact members having a second portion which projects from the insulating pod and is of a length which is sufficient to reach one of said compartment contact terminals when said insulating pod engages said door in the door closed condition and the plate contact terminals are in straddle relationship to said door and extend into said compartment whereby when the hearing aid battery is removed from said compartment, the plate contact members of said second cable connector may be placed in straddle relationship to the battery compartment door, flexed towards one another at their distal ends and inserted into the hearing aid battery compartment by closing the battery compartment door and causing their electrical contact with said hearing aid terminals.

2. An apparatus as set forth in claim 1 wherein the material for encapsulating the first end portions of said plate contact members is of hardened plastic material.

3. An apparatus as set forth in claim 2 wherein the material for encapsulating the first end portions of said plate contact members is of hard acrylic polymer.

4. An apparatus as set forth in claim 1 wherein the portion of the cable adjacent to its connection with the plate contact members is provided with a tight-fitting sleeve of strain relieving tubing which extends a distance outwardly from said pod by an amount which is sufficient to provide strain relief for the cable conductors from flexing forces imposed on said cable at locations adjacent to said pod.

5. An apparatus as set forth in claim 4 wherein said strain relieving tubing is silicone tubing.

6. In an apparatus for testing a hearing aid instrument where the hearing aid instrument includes a housing having a battery compartment therein with an access opening to said compartment and first and second contact terminals provided in said compartment in laterally spaced relationship to one another and adapted to engage the electrodes of the hearing aid battery when the battery is received in said compartment and said battery compartment is provided with a door having a width corresponding to the thickness of the battery and adapted to be positioned to close said opening, said improvement comprising:

a flexible electrical cable including a pair of electrical conductors and having a first connector at one end for electrically coupling the cable to a source of d.c. power;

a second connector at the opposite end of said cable, said second connector comprising a pair of resilient plate contact members in laterally spaced array, each plate contact member being coupled to a different one of the cable conductors with a first end portion of each plate contact member being encapsulated in a rigid molded insulating pod fixed to said opposite end of said cable and the spacing between said plate contact members being slightly less than the thickness of the button battery, each of said plate contact members having a second portion which projects from the insulating pod and has a length such that when said insulating pod engages the door in its closed position and said plate contact terminals are in straddle relationship to said closed door and extended into said compartment, each said plate contact member engages a different one of said first and second compartment contact terminals, said insulating pod having means for indicating orientation of said pod with respect to said door whereby when the hearing aid battery is removed from said compartment, the plate contact members of said second cable connector may be placed in straddle relationship to the battery compartment door and in electrical contact with the hearing aid terminals of corresponding electrical polarity by closing said door.

* * * * *